US011312536B2

(12) United States Patent
Fox

(10) Patent No.: US 11,312,536 B2
(45) Date of Patent: Apr. 26, 2022

(54) ATTACHMENT DEVICE FOR ATTACHING DECORATIONS TO A BEVERAGE CONTAINER

(71) Applicant: Loraine Marie Fox, Gilroy, CA (US)

(72) Inventor: Loraine Marie Fox, Gilroy, CA (US)

( * ) Notice: Subject to any disclaimer, the term of this patent is extended or adjusted under 35 U.S.C. 154(b) by 0 days.

(21) Appl. No.: 17/247,284

(22) Filed: Dec. 7, 2020

(65) Prior Publication Data

US 2021/0086946 A1 Mar. 25, 2021

Related U.S. Application Data

(63) Continuation-in-part of application No. 16/150,474, filed on Oct. 3, 2018, now abandoned.

(51) Int. Cl.
*B65D 23/14* (2006.01)
*G09F 3/16* (2006.01)

(52) U.S. Cl.
CPC ..... *B65D 23/14* (2013.01); *G09F 3/16* (2013.01); *B65D 2203/00* (2013.01)

(58) Field of Classification Search
CPC A47G 19/2227; A47G 19/2255; G09F 3/005; G09F 3/08; G09F 3/20; G09F 3/16; G09F 3/06; G09F 2003/0251; G09F 2003/0273; G09F 2003/0272; G09F 2003/0279; G09F 2003/0208; G09F 2003/0275; B65D 23/14; B65D 2203/00; B65D 2203/02
USPC ..... 220/694; 206/457–458, 459.5, 477; 403/408.1; 24/453; 40/651, 633, 124.05, 40/661.03, 666
See application file for complete search history.

(56) References Cited

U.S. PATENT DOCUMENTS 1,865,835 A * 7/1932 Colby ..... G09F 1/14 40/310
2,976,629 A * 3/1961 Lubis ..... G09F 3/16 40/310
4,951,596 A * 8/1990 Wallace, Jr. ..... G09F 3/16 116/323
5,358,770 A * 10/1994 Evans ..... B44C 5/00 40/310
6,637,447 B2 * 10/2003 McMullin ..... A47G 23/00 206/217
7,185,452 B2 * 3/2007 Brown ..... G09F 5/00 40/310
8,999,477 B2 * 4/2015 Hirth ..... G09F 3/0294 40/310
2003/0173326 A1 * 9/2003 Levy ..... B65D 23/14 215/365

(Continued)

*Primary Examiner* — Robert Poon
(74) *Attorney, Agent, or Firm* — Dunlap Bennett & Ludwig, PLLC

(57) ABSTRACT

An attachment device having a clip portion and a display element removably attachable to the clip portion. The clip portion is generally arcuate and dimensioned to slide down and engage a neck of a beverage container. The display element provides a pivotable snap-fit mechanism for operatively associating with a clasp pivot post and spaced apart attachment points of the clip portion. The display element provides an indicia medium for prominently displayed a message or design thereon, whereby the message may provide the occasion and/or sentiment associated with the engaged beverage container, all while allowing the container's intrinsic label to be readily visible.

8 Claims, 4 Drawing Sheets

(56) References Cited

U.S. PATENT DOCUMENTS

| | | | | |
|---|---|---|---|---|
| 2011/0139803 | A1* | 6/2011 | Leslie | A47G 23/0216<br>206/459.5 |
| 2015/0047998 | A1* | 2/2015 | Horn | B65D 25/205<br>206/459.5 |

* cited by examiner

ATTACHMENT DEVICE FOR ATTACHING DECORATIONS TO A BEVERAGE CONTAINER

CROSS-REFERENCE TO RELATED APPLICATION

This application claims the benefit of priority of U.S. non-provisional application Ser. No. 16/150,474, filed 3 Oct. 2018, as a continuation thereof, the contents of which are herein incorporated by reference.

BACKGROUND OF THE INVENTION

The present invention relates to beverage container accessories and, more particularly, to an attachment device for attaching decorations and messages to a beverage container.

Bottles of wine and spirits are commonly given as gifts; however, they lack the capacity to display a relevant message or indicia as to why they are being given to the recipient or to whom they are being given.

A gifted beverage container typically is presented in a gift bag, but such packaging hides the bottle and its label so that when the container is given only the packaging is visible until pulling the bottle out of bag. Once the proverbial cat is out of the bag any message attached to the gift bag is soon forgotten. Furthermore, paper wine bags can tear or rip, their handles break off, and the bags they come in can wrinkle or otherwise be marred. Adding a bow to the bottle to convey a message also has its disadvantages; for example, the bow can droop or overshadow the message. Similarly, gift cards can easily detach from the gifted bottle. As a result, the gifted bottle will no longer has an associative celebrative message, and thus the intent for giving the gift is lost.

In short, the current ways gift-givers of bottles of wine or spirits convey the message behind such gifts—e.g., through a gift card, a wine bag, or the like—tend to fail by becoming physically detached from the gifted bottle or being overlooked. Whereby, the "thought that counts" embodied in these other approaches become quickly disassociated with the gift.

As can be seen, there is a need for an attachment device for attaching decorations and messages to a beverage container that are highly associated therewith, yet removable. The present invention embodies an attachment device adapted to easily slip over the top of a bottle neck and instantly becomes a part of the bottle. The display element may include a celebratory display features and an indicia surface where a message or other indicia can selectively be applied thereto for the user to associate a desired message with the bottle. For example, the message may be the occasion for which the gift giver is giving the wine along with a sentimental expression related thereto as well as displaying the type of wine being gifted, all while allowing the wine label to be seen. Thus, the wine bottle and a decorative attachment device attached is the gift.

SUMMARY OF THE INVENTION

In one aspect of the present invention, an attachment device for a beverage container with an elongated neck includes the following: a clip portion having: two semi-arcuate arms, each extending between a distal end and a proximal end, the two arms defining a distal void and a proximal void at the distal and proximal ends, respectively; a clip pivot point spanning the distal void and interconnecting the distal ends; and two arm attachment points on each distal end, respectively, spaced apart from the clip pivot point; and a display element having: a clasp; two display attachment points, wherein the clasp pivotably connects to the clip pivot point and the two display attachment points move between an unlocked engagement and a locked engagement with the two arm attachment points; and an indicia medium.

In another aspect of the present invention, the attachment device for a beverage container with an elongated neck includes the following: the indicia medium is opposing the clasp and the two display attachment points, wherein the indicia medium comprises a message, wherein the clasp comprises two or more clasp protrusions spaced apart to snugly receive the clasp pivot post therebetween, wherein each protrusion comprises a notch defined by an outward protrusion having a tapered face, wherein the locked engagement comprises at least one outward protrusion nested in one notch, wherein immediately prior to the locked engagement comprises at least two tapered faces are engaged.

In yet another aspect of the present invention, a method for providing a personalized message associated with a bottled gift, the method includes the following: providing the above-mentioned attachment device; sliding said attachment device down a neck of the bottled gift; applying a message onto said indicia medium; and pivoting the display portion from the unlocked engagement o the locked engagement.

These and other features, aspects and advantages of the present invention will become better understood with reference to the following drawings, description and claims.

DETAILED DESCRIPTION OF THE INVENTION

Figure 1:
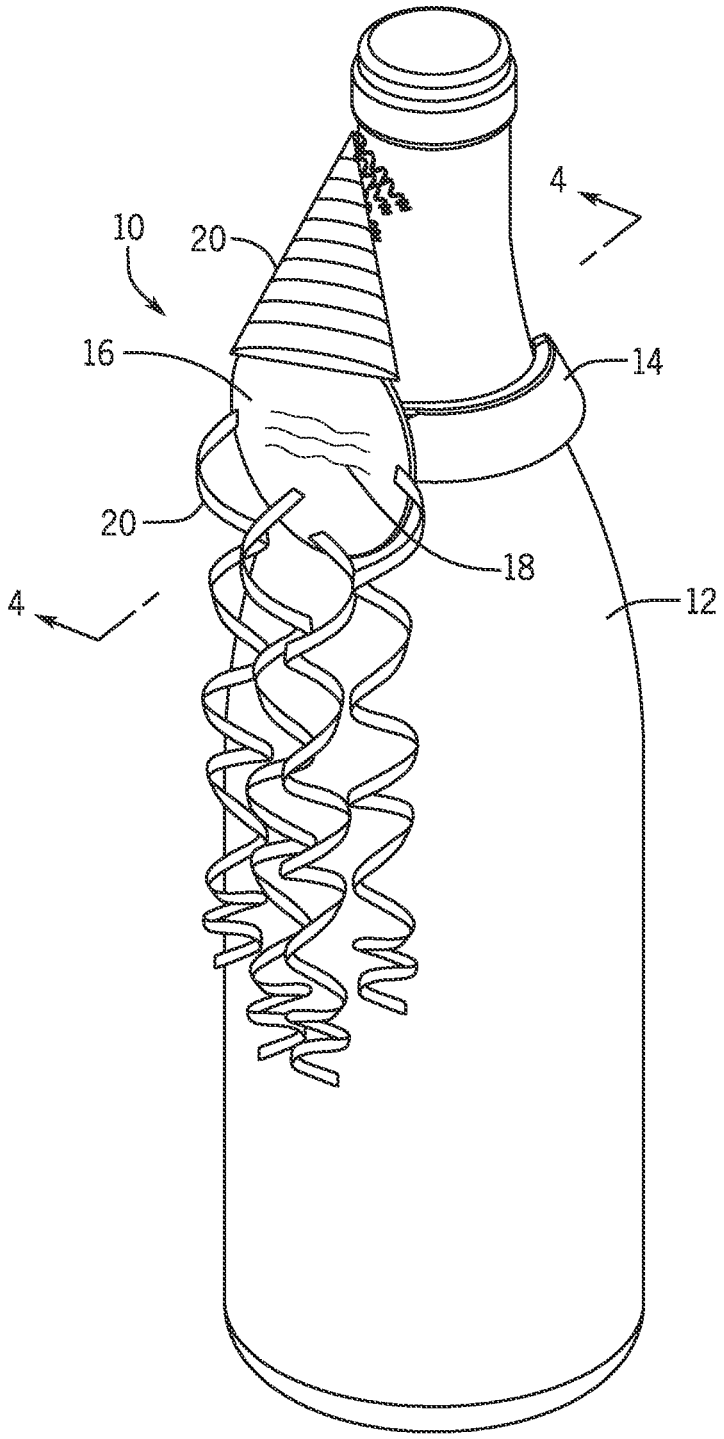
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an attachment device having a clip portion and a display element removably attachable to the clip portion. The clip portion is generally arcuate and dimensioned to slide down and engage a neck of a beverage container. The display element provides a pivotable snap-fit mechanism for operatively associating with a clasp pivot post and spaced apart attachment points of the clip portion. The display element provides an indicia medium for prominently displayed a message or design thereon, whereby the message may provide the occasion and/or sentiment associated with the engaged beverage container, all while allowing the container's intrinsic label to be readily visible.

Referring to FIGS. 1 through 4, the present invention may include an attachment device 10 or 30 for coupling to a bottle 12, the attachment device 10 or 30 providing a clip portion 14 or 32 and a display element 16 or 34. The attachment device 10 or 30 may be made from various plasticized materials, such as Acrylonitrile Butadiene Styrene, or other materials capable or repeat bending without fracture and amenable to injection molding and/or additive manufacturer. The plasticized materials may also have adhesive properties.

The clip portion 14 or 32 may be adapted to operatively associate with a neck of the bottle 12, it being understood that the neck is generally elongated in shape and connects to a wider body portion of the bottle 12. The clip portion 14 or 32 may be generally arcuate but not an endless loop; rather the clip portion 14 or 32 may provide opposing semi-arcuate arms 44 that terminate before converging at a proximal end and a diametrically opposed distal end, thereby defining a proximal void 50 and a distal void 52, as illustrated in FIGS. 2 and 3.

At the distal end of the clip portion 14 or 32, spanning the distal void 52 and extending between the opposing arms 44, may be a clasp pivot post 36*a* along an upward portion of said distal void 52. Adjacent the distal void 52 along downward portions of each arm 44, and thus spaced apart from said clasp pivot post 36*a*, may be two spaced apart arm attachment points 38*a*. Each arm attachment point 38*a* may provide a downward-facing notch defined by an outward protrusion with an outward tapered face 39*a*, as illustrated in the FIG. 2.

Figure 2:
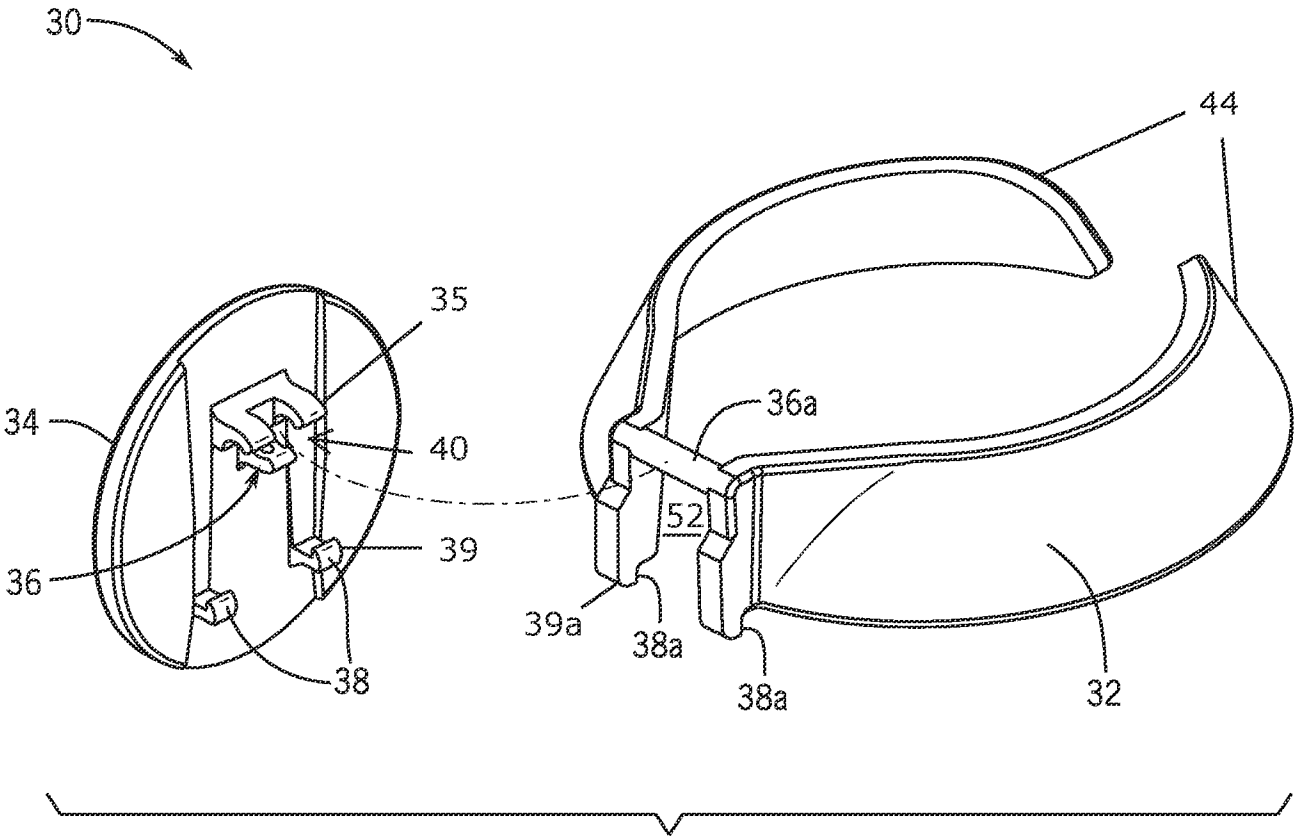
FIG. 2 is an exploded perspective view of an exemplary embodiment of the present invention.
Figure 3:
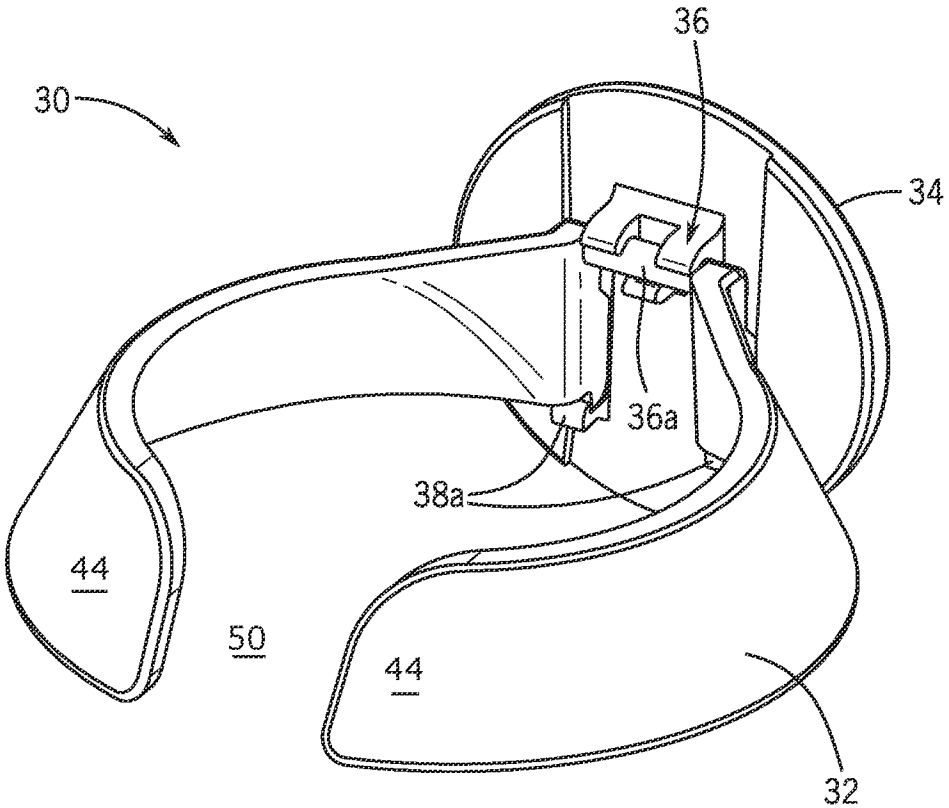
FIG. 3 is a perspective view of an exemplary embodiment of the present invention.
Figure 4:
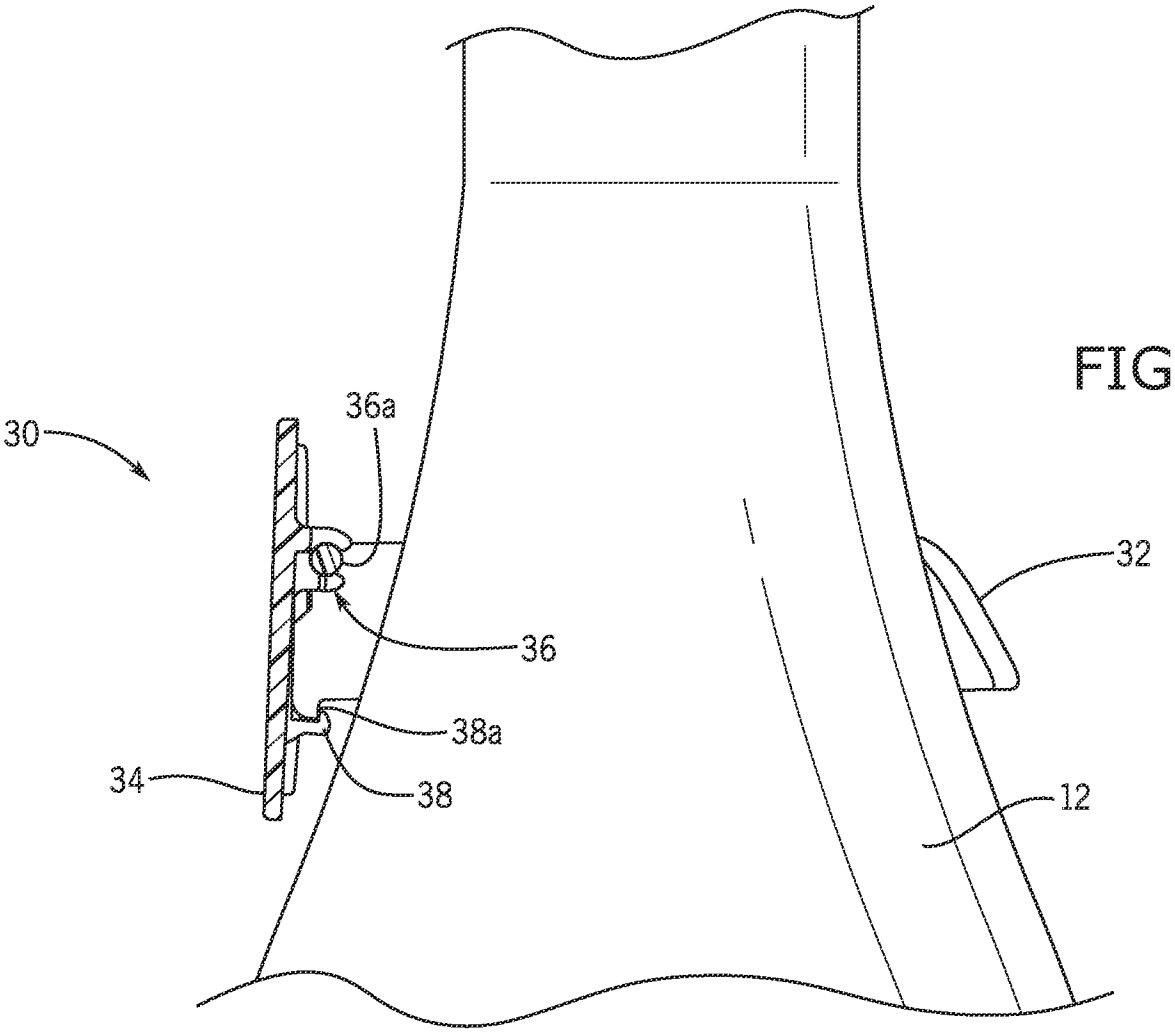
FIG. 4 is a cross-sectional view of an exemplary embodiment of the present invention, taken along line 4-4 in FIG. 1.

It should be understood by those skilled in the art that the use of directional terms such as upward, downward, outward and the like are used in relation to the illustrative embodiments as they are depicted in the figures; the upward direction being toward the upper margin of FIG. 2; the outward direction being toward the margins of the corresponding figures; and so forth.

The display element 16 or 34 may provide a clasp 40 and two spaced apart display attachment points 38. The clasp 40 may provide at least two clasp protrusions 35 and 36 spaced apart to snugly receive the above-mentioned clasp pivot post 36*a* therebetween, thereby providing a pivoting snap on functionality. In certain embodiments, there may be two spaced apart upward clasp protrusions 35 and one downward clasp protrusion 36, as illustrated in FIG. 2. Each of the clasp protrusions 35 and 36 may have complementary curvatures for receiving a cylindrical clasp pivot post 36*a*.

The display attachment points 38 may each have upward notches defined by upward protrusions having outward tapered faces 39. Furthermore, the two spaced apart display attachment points 38 are dimensioned and adapted to simultaneously engage their complementary arm attachment point 38*a*, respectively, while the clasp 40 snaps on to the clasp post 36*a*. The unique arrangements of the clasp post 36*a* spaced apart from the two opposing arm attachment points 38*a* facilitates a pivotably snap on connection between the clip portion 32 and the display portion 34. The clasp 40 (specifically the clasp protrusions 35 and 36) may pivot about the clasp (pivot) post 36*a* until the outward tapered faces 39 and 39*a* of the (attachment points 38 and 38*a*) engage and slide into the complimentary notches.

The outward facing portion of the planar portion of the display element 16 or 34 provides a medium 18 for the attachment of messages, indicia, or the like. The planar portion may also provide a platform for adhering other decorative elements 20 thereto, as illustrated in FIG. 1.

A method of using the present invention may include the following. The attachment device 10 disclosed above may be provided. A user may slide the arcuate clip portion 14 or 32 down the neck of the bottle 12, the clip portion 14 or 32 stops when it reaches the shoulders of the body portion of the bottle 12, allowing for the flared lower portions of the arms 44 to be supported by the shoulders of the bottle 12, seemingly becoming a part of the bottle 12 as a celebrative feature. The snap-fit mechanism disclosed above enables the user to removably secure the display element 16 or 34 to the clip portion 14 or 32 when in use.

Likewise, the present invention may be used to selectively associate a bottle 12 (or other beverage container) to a certain individual, for example during a social event, so that the individuals at the social event can identify their own bottle 12 throughout an event comprising libations.

It should be understood, of course, that the foregoing relates to exemplary embodiments of the invention and that modifications may be made without departing from the spirit and scope of the invention as set forth in the following claims.

What is claimed is:

1. An attachment device for a beverage container with an elongated neck, comprising:

a clip portion comprising:

two semi-arcuate arms, each extending between a distal end and a proximal end, the two arms defining a distal void and a proximal void at the distal and proximal ends, respectively;

a clip pivot point spanning the distal void and interconnecting the distal ends; and two arm attachment points on each distal end, respectively, spaced apart from the clip pivot point; and a display element comprising:

a clasp;

two display attachment points, wherein the clasp pivotably connects to the clip pivot point and the two display attachment points move between an unlocked engagement and a locked engagement with the two arm attachment points; and an indicia medium.

2. The attachment device of claim 1, wherein the indicia medium is opposing the clasp and the two display attachment points.

3. The attachment device of claim 1, wherein the indicia medium comprises a message.

4. The attachment device of claim 1, wherein the clasp comprises two or more clasp protrusions spaced apart to snugly receive the clasp pivot post therebetween.

5. The attachment device of claim 4, wherein each protrusion comprises a notch defined by an outward protrusion having a tapered face.

6. The attachment device of claim 5, wherein the locked engagement comprises at least one outward protrusion nested in one notch.

7. The attachment device of claim 6, wherein immediately prior to the locked engagement comprises at least two tapered faces are engaged.

8. A method for providing a personalized message associated with a bottled gift, the method comprising:

providing the attachment device of claim 7;

sliding said attachment device down a neck of the bottled gift;

applying a message onto said indicia medium; and pivoting the display portion from the unlocked engagement to the locked engagement.

* * * * *